United States Patent [19]

Uerlichs et al.

[11] 3,970,109

[45] July 20, 1976

[54] SHUTOFF AND CONTROL SLIDE

[75] Inventors: Johannes Uerlichs, Woffelsbach; Rudolf Müller, Merzenich; Hermann-Josef Stolberg, Birkesdorf, all of Germany

[73] Assignee: Hermann Rappold & Co. GmbH, Duren, Germany

[22] Filed: Feb. 20, 1975

[21] Appl. No.: 551,509

[30] Foreign Application Priority Data

Feb. 27, 1974 Germany ..... 2409444

[52] U.S. Cl. ..... 137/601; 137/625.35; 251/282; 251/DIG. 1

[51] Int. Cl.[2] ..... F16K 1/44

[58] Field of Search ..... 137/625.33, 625.35, 137/601; 251/DIG. 1, 282, 332

[56] References Cited

UNITED STATES PATENTS

| | | | |
|---|---|---|---|
| 652,029 | 6/1900 | Lentz | 137/625.35 |
| 865,798 | 9/1907 | Peterson | 137/625.35 |
| 2,417,494 | 3/1947 | Hoof | 251/332 |
| 3,572,382 | 3/1971 | Luthe | 137/625.35 |

FOREIGN PATENTS OR APPLICATIONS

| | | | |
|---|---|---|---|
| 16,662 | 7/1914 | United Kingdom | 137/625.35 |

*Primary Examiner*—Robert G. Nilson
*Attorney, Agent, or Firm*—Wenderoth, Lind & Ponack

[57] ABSTRACT

A shutoff and control slide includes a cylinder having at least one row of circumferentially spaced elongated openings, and a sliding sleeve mounted for axial displacement in the cylinder. Rings are sealed to the inner surface of the cylinder on opposite axial sides of each row of openings, and each ring has an axially facing abutment surface. Abutment members, each having an axially facing abutment surface, extend outwardly from the sliding sleeve. Sealing members are provided on at least one of the ring and abutment member abutment surfaces.

22 Claims, 3 Drawing Figures

SHUTOFF AND CONTROL SLIDE

BACKGROUND OF THE INVENTION

The present invention relates to a shutoff and control slide of the type including a cylinder having therein radial openings, the cylinder having a sliding sleeve axially displaceable therein, in particular a sliding sleeve having openings therein, and packing means extending between the cylinder and the sliding sleeve for the purpose of sealing the opening of the cylinder when it is covered by the sliding sleeve.

Shutoff and control slides of the type described above have been disclosed repeatedly and are known to include an embodiment having slot-shaped openings in the cylinder and possibly also in the sliding sleeve, especially in association with hot blast furnaces, particularly of the Cowper type. In any case, a space surrounding the openings is adjacent to the exterior of the cylinder, which space must be shut off completely or in a controlled manner, by means of the shutoff and control slide, in relation to a second space that communicates continuously with the interior of the sliding sleeve. These two spaces are referred to in the following text as housing connections. The sliding sleeve is displaced axially in the cylinder by means of any suitable drive, both for complete shutting off and also for variable control. Thus, the opening of the cylinder is thus covered completely or in part by the sliding sleeve. In order to achieve satisfactory displacement of the sliding sleeve in the cylinder, while also insuring satisfactory reciprocal sealing between the above mentioned housing connections, piston rings have been employed. However, tests have shown that, in the case of a shutoff and control slide of the above mentioned kind used in connection with a hot blast furnace, the piston rings between the sliding sleeve and the cylinder of such a slide can only produce a seal that is not capable of meeting all requirements of load and operation for relatively long periods of time, due to the relatively slow progress of displacement operations and due to the long periods of rest of the sliding sleeve in its outer or end limit positions. Also, the costs for machining the cylinder are relatively high, and, finally, costs are also high due to the susceptibility of the piston rings to corrosion.

SUMMARY OF THE INVENTION

Accordingly, the object of the present invention is to provide an improved shutoff and control slide of the type described above, so as to overcome the disadvantages relating to the effectiveness and duration of seal and occurring in connection with previously known slides of this type.

It is particularly the object of the present invention to provide such a slide which is useable in Cowper installations, i.e., to provide a slide such the problems caused by the increasing pressure levels and temperatures as well as by the amounts of throughflow in the operation of blast furnaces, and also by the plurality of the required control and regulation procedures, can be solved in a manner which is structurally simple and advantageous with regard to captial investment expenses and operation costs.

The above objects are achieved in accordance with the present invention by providing continuous annular abutment rings having axially facing abutment surfaces axially on either side of the cylinder openings, which abutment rings are adjacent and sealed to the inner surface of the cylinder. The invention further provides two continuous annular axial spaced abutment members having axially facing abutment surfaces that are adjacent and sealed to the outer surface of the sliding sleeve. The axial distance between the axial abutment surfaces of the abutment members corresponds to that of the abutment surfaces of the rings. The invention also provides an axial sealing element on at least one of the abutting surfaces of each abutting sliding sleeve and/or cylinder. Owing to this arrangement, the continuous circular sealing elements previously provided between the sliding sleeve and the inner surface of the cylinder, and acting as piston rings during the displacement of the sliding sleeve, are replaced in the present invention by sealing elements that are arranged stationary at the axial abutment areas of the inner surface of the cylinder and/or the axial abutment areas of the outer surface of the sliding sleeve. Thus, during displacement of the sliding sleeve, the sealing elements are not subjected to frictional contact. Accordingly, frictional wear of the sealing elements cannot take place. While the piston rings of the known shutoff and control slides are subjected to frictional contact, and thus to stress not only during every instant of operation of the slide but also when the slide is not operated, the axial sealing elements in accordance with the invention are stressed by the forces acting on the sliding sleeve for holding it in the closing position exclusively during the periods when a sealing effect is desired.

In order to develop further advantageously the concept of the invention, the abutment surfaces of the cylinder and/or the sliding sleeve consist of fixed rings provided on such parts, and such rings may consist of integral steps or flanges of the cylinder and/or the sliding sleeve. However, as an alternative arrangement, the rings of the cylinder and of the sliding sleeve may be independent components. Thus, the parts subjected to wear can be readily replaced according to the invention.

In the case where the rings are independent components, the invention further provides that the rings of the cylinder and/or the sliding sleeve be fixed in the direction of abutment by a step on the inner surface of the cylinder and/or the outer surface of the sliding sleeve, and/or possibly bolted to the wall of the cylinder and/or the sliding sleeve. The advantageous result of fixing the rings in the direction of abutment is that the forces acting on the sliding sleeve for the purpose of closing the openings of the cylinder (which forces effect sealing by means of the axial sealing elements after the closing position is attained) need not be absorbed by the connection elements (e.g., bolts) of the rings. Further, the fixing of the rings by means of the above-mentioned step provides for simple and fast mounting of the rings.

In principle it is indeed possible to shrink-fit the rings into the cylinder and/or on the sliding sleeve, in which case one must perform a very precise machining in order to obtain the necessary sealing effect between the rings and the inner surface of the cylinder and/or the outer surface of the sliding sleeve. However, such a very costly precise machining of the rings and also of at least certain partial areas of the cylinder and/or the sliding sleeve may be omitted if, in accordance with a further feature of the invention, a packing, such as an O-ring packing, is provided in each case between the independent component rings of the cylinder and/or the sliding sleeve and the inner surface of the cylinder and/or the outer surface of the sliding sleeve. Thus, it is possible to use the inner surfaces of the cylinder and the outer surfaces of the sliding sleeve, which surfaces are premachined at most very coarsely. The same is also valid for the rings.

In regard to the axial sealing elements provided on the abutment surfaces of the cylinder and/or the sliding sleeve, it is a further feature of the invention that such sealing elements should consist of continuous annular sealing rings. It is further contemplated that such sealing rings be arranged at identical radial distances from the axis of the cylinder and/or the sliding sleeve. After the sliding sleeve is shifted to a suitable extent for covering the opening or openings of the cylinder, this arrangement provides for the possibility of omitting the requirement of special holding forces for holding the sliding sleeve firmly in such a position, since the sliding sleeve is subjected to forces of identical magnitude in both directions of its axis, i.e., the forces cancel each other, thus requiring no external reaction force. Insofar as the length of the sliding sleeve component and/or the length of its displacement, or the stresses which occur, require that the concentric position of the sliding sleeve in the cylinder be secured (which is effected by means of piston rings in the case of shutoff and control slides that are equipped with such), the invention proposes in this connection that the sliding sleeve be provided with guide means for the purpose of its central mounting and/or displacement in the cylinder. In particular it may be provided that such guide means should consist of a thrust rod extending through the sliding sleeve, and being radially mounted on two sides and displaceable in the axial direction, the displacement of the sliding sleeve being simultaneously achieved by means of such a rod. As an alternative arrangement, the guide means may consist of sliding and/or roller elements arranged on the outer surface of the sliding sleeve, the elements contacting corresponding guide surfaces of the inner surface of the cylinder. In any case, due to the guide means of the invention, the axial sealing means between the cylinder and/or the sliding sleeve do not participate in any way in the guiding of the sliding sleeve within the cylinder.

However, on the other hand, in the case of a shutoff and control slide comprising a plurality of separate cylinders and sliding sleeves arranged in a housing, which housing is divided in such a manner that the openings in the cylinders are jointly connected to a first housing connection, and that the open axial ends of the cylinders are jointly connected to a second housing connection, it is possible to provide that every continuous annular sealing means between the cylinders and sliding sleeves, for sealing the cylinder openings when covered by the sliding sleeves, may be constructed in accordance with the invention in the manner described above.

Further, in the case where every cylinder is equipped with at least two rows of openings, it is possible to provide that the rows of openings of the separate cylinders situated at the same level be jointly connected to different housing connections, while the open axial ends of the cylinders are connected to a further housing connection. In such a case, the sliding sleeves are constructed to close every row of openings in a first position, a first row of openings when situated in a second position, and a second row of openings when situated in a third position.

Naturally, it is possible to provide that all the sliding sleeves have a common drive and that all the cylinders and sliding sleeves of the shutoff and control slide, and preferably of the entire installation of a Cowper, possess identical dimensions.

BRIEF DESCRIPTION OF THE DRAWINGS

The present invention will be described in more detail in the following text with reference to the attached invention wherein.

DETAILED DESCRIPTION OF THE INVENTION

Figure 1:
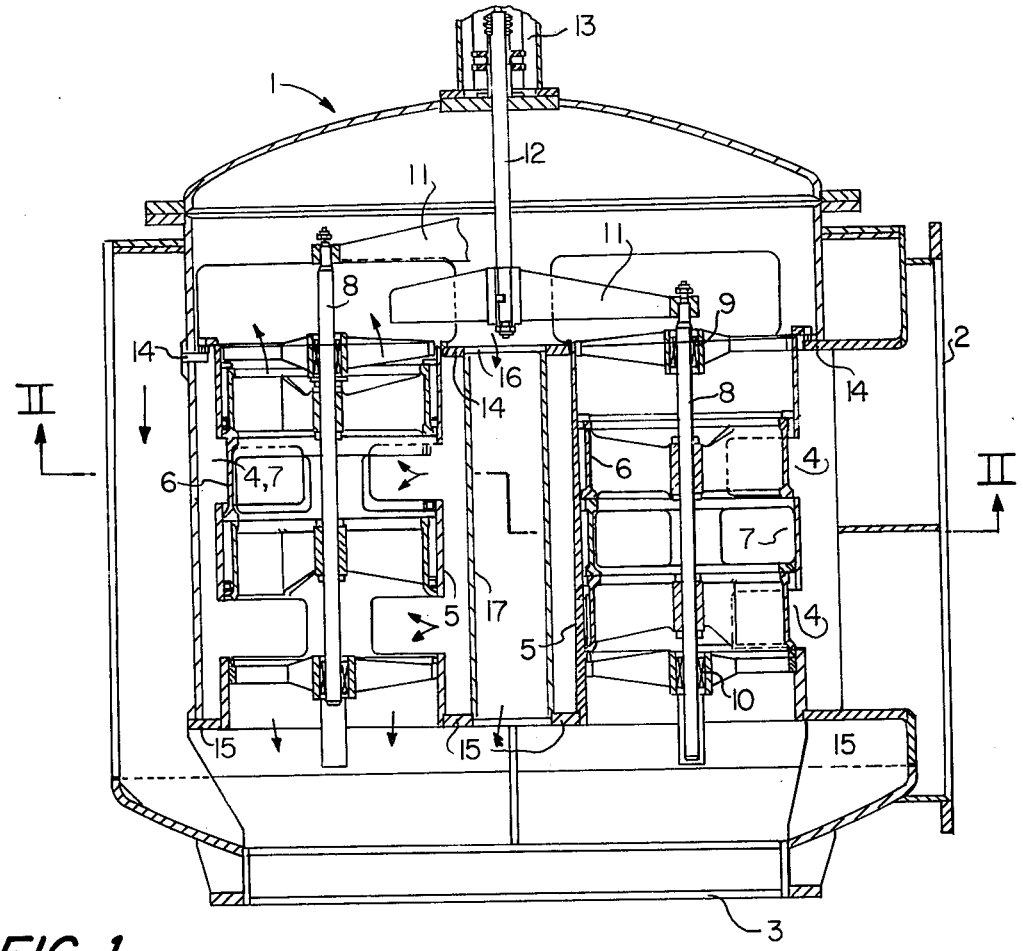
FIG. 1 is a longitudinal section through a preferred embodiment of the shutoff and control slide of the inventin taken along the line I—I of FIG. 2.
Figure 2:
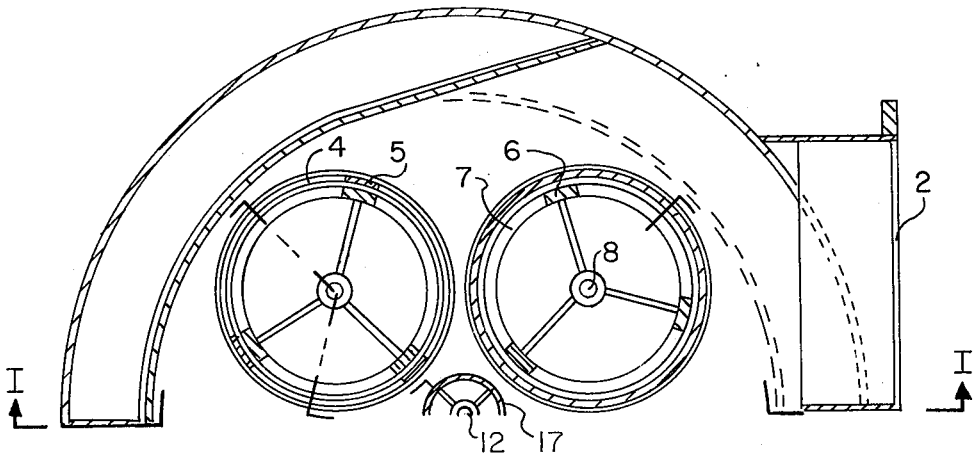
FIG. 2 is a partial cross section through the preferred embodiment taken along the line II—II of FIG. 1.

The preferred embodiment of the invention shown in FIGS. 1 and 2 includes a housing 1 having a first housing connection 2 and a second housing connection 3. Four cylinders 5 having rows or galleries of slot-shaped or elongated openings 4 are uniformly circumferentially distributed within the interior of housing 1. A sliding sleeve 6, likewise having rows of slot-shaped openings 7 therein, is inserted in the interior of each cylinder 5 for axial movement with respect thereto. A thrust rod 8 is provided at the center of each sliding sleeve 6, the rod being mounted for axial displacement in bearings 9 and 10, that are supported at the open opposite ends of cylinders 5. All the thrust rods 8 are connected by means of a common tie beam 11 to a setting or movement member 12, that is connected to a control or setting drive 13 which is merely schematically illustrated.

At the level of the upper and lower ends of cylinders 5, housing 1 is divided by respective transverse partitions 14 and 15 that have therein openings for the insertion of cylinders 5. Further, transverse partitions 14 and 15 have a central opening 16, which receives a cylinder wall 17, through the interior of which the space situated above partition 14 communicates with housing connection 3. Further, housing connection 3 also communicates with the lower ends of cylinders 5 and/or with sliding sleeves 6 situated in the cylinders. Housing connection 2 communicates with the space remaining between the outer sides of cylinders 5 and the outer side of cylinder wall 17 and the inner wall of the housing 1, which space communicates through the slot-shaped openings 4 of cylinders 5 with the interior of sliding sleeves 6, when slot-shaped openings 4 are not covered by sliding sleeves 6.

As seen particularly from the position of the line I—I of FIG. 2, cylinders 5 and sliding sleeves 6, illustrated as situated in the plane of the drawings in FIG. 1, are actually displaced or set back in the shown preferred embodiment in relation to a perpendicular plane extending through the center of housing connection 2 and the central axis of the slide.

Figure 3:
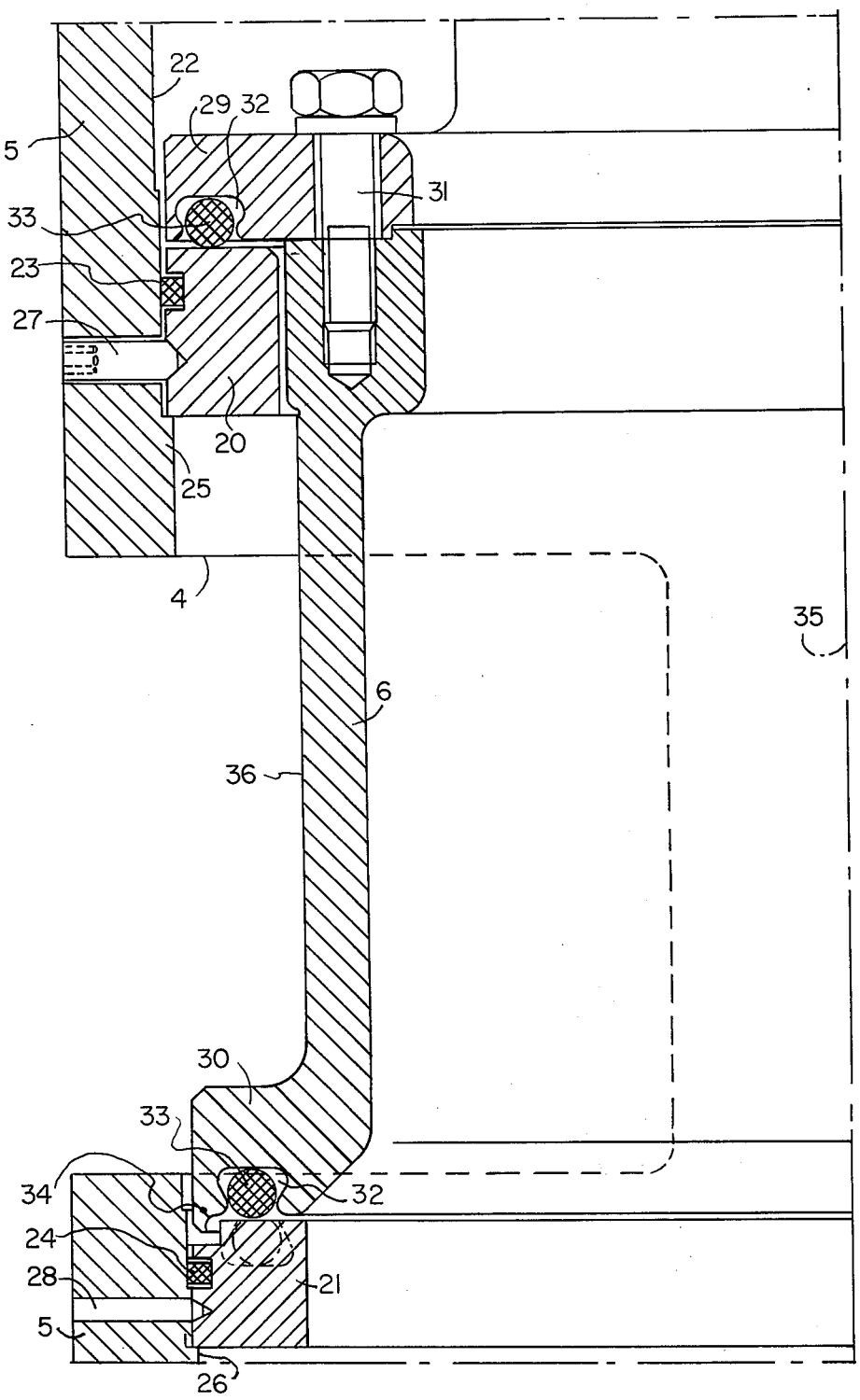
FIG. 3 is a partial axial detailed section through the sealing arrangement between the sliding sleeve and the cylinder when the opening of the cylinder is covered by the sliding sleeve.

According to the detailed illustration of FIG. 3, a ring 20 or 21 is positioned on either side of each row of slot-shaped openings 4 of each cylinder 5, for the purpose of forming stationary axial abutment members. Rings 20 and 21 are sealed such as by means of O-ring packings 23 and 24 to the inner surface 22 of the cylinder 5, and rings 20 and 21 are abutted with steps 25 and 26 of inner surface 22 of the cylinder, in which position they are fixed by means such as lock or set bolts 27 and 28. The direction of steps 25 and 26 is selected such that rings 20 and 21 are pressed toward steps 25 and 26 by sliding sleeve 6, when sleeve 6 is shifted in the direction to cover or close openings 4 of cylinder 5.

At the same axial spacing which is provided between the axial abutment surfaces of rings 20 and 21, movable axial abutment members having abutment surfaces are provided on sliding sleeve 6. One such axial abutment member is formed by a ring 29, and the other such member is formed by a flange 30 of sliding sleeve 6, which elements extend outwardly of outer surface 36 of sleeve 6. Ring 29 is an independent element which is joined to sliding sleeve 6 by means such as bolt connections 31. Continuous circular grooves 32 are provided both in ring 29 and also in flange 30. Such grooves are dovetail-shaped in cross section, and a circular sealing element such as an O-ring packing 33 is inserted into each groove 32. O-ring packings 33 must contact the corresponding axial abutment surface of ring 20 or 21 when sliding sleeve 6 covers openings 4 of cylinder 5. In addition to grooves 32, or even as an alternative thereto, it is also possible to provide a corresponding groove in rings 20 and 21, as indicated by the dashed lines in ring 21. A byflow projection 34 is provided on flange 30 for the purpose of protecting the O-ring packing 33 in the groove 32 arranged in flange 30 of sliding sleeve 6 when the openings 4 of cylinder 5 are uncovered.

Similarly to the provision of ring 29, it is also possible to provide an independent ring in place of flange 30, which ring would have to be bolted to sliding sleeve 6. In contrast to the embodiment of FIGS. 1 and 2, the detailed illustration of FIG. 3 shows a shutoff and control slide whose cylinder 5 is provided with only a single row of slot-shaped openings 4. However, it can be readily seen that the sliding sleeve 6 can be extended into the area of a second row of openings 4 in the cylinder 5 by suitably extending sliding sleeve 6 beyond the lower end thereof as represented in FIG. 3. Of course, a second flange corresponding to flange 30 or a corresponding ring would have to be provided for such a purpose in the area of the second row of openings 4. Naturally, sliding sleeve 6 must possess a suitable diameter so that it can be passed through the interior of ring 21.

In the illustration of FIG. 3, O-ring packings 33 of ring 20 and/or flange 30 are maintained at different radial distances from an axis 35 of cylinder 5 or sliding sleeve 6, so that the action of pressure on sliding sleeve 6 does not produce an equilibrium of forces in the axial direction of sliding sleeve 6. Accordingly, in order to shift sliding sleeve 6 in the interior of cylinder 5 there is required a force which is intensified to a corresponding slight extent. However, as can be readily seen, such an increase in force can be avoided without substantial difficulties by arranging O-ring packings 33 of ring 29 and flange 30 at identical radial distances from axis 35 of cylinder 5 or sliding sleeve 6.

It will be apparent that modifications may be made to the specifically described and illustrated embodiments without departing from the spirit and scope of the invention.

What is claimed is:

1. A shutoff and control slide comprising:

an open-ended cylinder having therein at least one row of circumferentially spaced elongated openings;

an open-ended sliding sleeve mounted for axial displacement within said cylinder;

a plurality of rings sealingly positioned against the inner surface of said cylinder, one each on each axial side of said at least one row of openings in said cylinder, each of said rings having an axially facing annular abutment surface, the abutment surfaces of said rings being spaced by a predetermined axial distance;

a plurality of abutment members, equal in number to said plurality of rings, extending outwardly from the outer surface of said sliding sleeve, each of said abutment members having an axially facing abutment surface, the axial spacing between adjacent of said abutment surfaces of said abutment members being equal to said predetermined axial distance;

sealing members positioned on at least one of said abutment surfaces of said abutment members and said abutment surfaces of said rings; and said sliding sleeve being axially movable from a first position wherein said abutment surfaces of said abutment members and said abutment surfaces of said rings are sealed by said sealing members and said openings in said cylinder are sealingly covered by said sliding sleeve, to a second position wherein said abutment surfaces of said abutment members and said abutment surfaces of said rings are spaced apart and said openings in said cylinder are uncovered by said sliding sleeve.

2. A slide as claimed in claim 1, wherein said cylinder has therein at least two rows of circumferentially spaced elongated openings; and said sliding sleeve has therein a number, equal to the number of said rows of openings in said cylinder less one, of rows of circumferentially spaced elongated openings.

3. A slide as claimed in claim 1, wherein said rings are fixedly positioned on said cylinder, and said abutment members are fixedly positioned on said sliding sleeve.

4. A slide as claimed in claim 1, wherein at least a portion of said abutment members are ring-shaped elements.

5. A slide as claimed in claim 1, wherein at least a portion of said rings are integral with said cylinder.

6. A slide as claimed in claim 1, wherein at least a portion of said abutment members are integral with said sliding sleeve.

7. A slide as claimed in claim 1, wherein at least a portion of said rings are separate elements.

8. A slide as claimed in claim 7, further comprising reduced diameter step portions in said cylinder, each of said separate rings abutting one of said step portions.

9. A slide as claimed in claim 7, further comprising bolt means fixing each of said separate rings to said cylinder.

10. A slide as claimed in claim 7, further comprising sealing means sealing each of said separate rings to said inner surface of said cylinder.

11. A slide as claimed in claim 1, wherein at least a portion of said abutment members are separate elements.

12. A slide as claimed in claim 11, further comprising step portions in said sliding sleeve, each of said separate abutment members abutting one of said step portions.

13. A slide as claimed in claim 11, further comprising bolt means fixing each of said separate abutment members to said sliding sleeve.

14. A slide as claimed in claim 11, further comprising sealing means sealing each of said separate abutment members to said sliding sleeve.

15. A slide as claimed in claim 1, wherein said sealing members comprise O-ring packings.

16. A slide as claimed in claim 15, wherein axially adjacent of said O-ring packings are equally radially spaced from a longitudinal axis of said cylinder and said sliding sleeve.

17. A slide as claimed in claim 15, wherein axially adjacent of said O-ring packings are unequally radially spaced from a longitudinal axis of said cylinder and said sliding sleeve.

18. A slide as claimed in claim 1, further comprising means for guiding the axial movement of said sliding sleeve within said cylinder.

19. A slide as claimed in claim 18, wherein said guiding means comprises an axially displaceable rod attached interiorly of said sliding sleeve.

20. A slide as claimed in claim 18, wherein said guiding means comprises interengaging guiding surfaces on the outer surface of said sliding sleeve and the inner surface of said cylinder.

21. A shutoff and control slide assembly comprising a housing having therein a plurality of shutoff and control slides as claimed in claim 1, and further comprising a first housing connection in said housing jointly communicating with said openings in said cylinders, and a second housing connection in said housing jointly communicating with open ends of said sliding sleeves and said cylinders.

22. An assembly as claimed in claim 21, further comprising means to simultaneously axially displace all of said sliding sleeves.

* * * * *